US007029380B2

(12) United States Patent
Horiguchi et al.

(10) Patent No.: US 7,029,380 B2
(45) Date of Patent: Apr. 18, 2006

(54) DOUBLE-SIDE POLISHING METHOD AND APPARATUS

(75) Inventors: Akira Horiguchi, Kashiwara (JP); Shoji Nakao, Tokyo (JP)

(73) Assignees: Kashiwara Machine Mfg. Co., Ltd., Kashiwara (JP); Sumitomo Mitsubishi Silicon Corporation, Tokyo (JP)

( * ) Notice: Subject to any disclaimer, the term of this patent is extended or adjusted under 35 U.S.C. 154(b) by 0 days.

(21) Appl. No.: 11/014,776

(22) Filed: Dec. 20, 2004

(65) Prior Publication Data

US 2005/0159089 A1 Jul. 21, 2005

(30) Foreign Application Priority Data

Dec. 22, 2003 (JP) ..... 2003-425289
Apr. 22, 2004 (JP) ..... 2004-127074

(51) Int. Cl.
*B24B 7/00* (2006.01)

(52) U.S. Cl. ..... 451/262; 451/268; 451/41

(58) Field of Classification Search ..... 451/41, 451/63, 262, 268, 259, 269–272, 261, 264
See application file for complete search history.

(56) References Cited

U.S. PATENT DOCUMENTS 6,361,418 B1 * 3/2002 Inada ..... 451/262
6,830,505 B1 * 12/2004 Kobayashi et al. ..... 451/262
2005/0124264 A1 * 6/2005 Tominaga et al. ..... 451/41

FOREIGN PATENT DOCUMENTS

JP 2001315057 * 11/2001

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

In order to improve a flatness of a work in single wafer type double-side polishing in which one wafer is polished with one carrier, a carrier larger in diameter than upper and lower surface plates that rotate is inserted between the surface plates, and a wafer smaller in diameter than the surface plates is held with the carrier. The carrier is rotated by plural eccentric gears that mesh with external gear teeth formed on the outer peripheral surface of the carrier at plural positions along a circumferential direction thereof and revolve around positions spaced from the centers as centers in synchronism with each other or one another at the plural positions of meshing. The carrier rotates about its center and moves circularly around the center of the surface plates spaced from the center thereof. The upper surface plate is reciprocated in a direction perpendicular to the central axis when required. Geometrical motion loci of points on the wafer are complex and peripheral speeds alter to large extents to thereby enhance equalization of peripheral speeds of points on the wafer to a higher level to thereby improve a flatness.

10 Claims, 7 Drawing Sheets

DOUBLE-SIDE POLISHING METHOD AND APPARATUS

BACKGROUND OF THE INVENTION

1. Field of the Invention

The present invention relates to single carrier type double-side polishing method and apparatus suitable for both-surface polishing of a semiconductor wafer, which is a raw material for a semiconductor device, and more particularly, to double-side polishing method and apparatus suitable for single wafer type polishing which processes one wafer with one carrier.

2. Description of the Related Art

As for double-side polishing of a semiconductor wafer, which is a raw material for a semiconductor device, there has been well used a planetary gear mechanism type double-side polishing apparatus. A planetary gear mechanism type double-side polishing apparatus is a kind of a batch type apparatus simultaneously polishing both surfaces of each of plural wafers. In a planetary gear mechanism type double-side polishing apparatus, plural carriers are inserted between rotatable upper and lower surface plates. The plural carriers are sufficiently smaller in diameter than the surface plates and are arranged around a rotation center of the surface plates while each holding one or plural wafers and each conducting a planetary motion in company with rotation of the surface plates. Thereby, the wafer held in each the carrier is polished on both surfaces thereof between the surface plates.

In recent years, semiconductor wafers subjected to both-surface polishing have rapidly increased in diameter to as large as 300 mm. It is expected to further increase a diameter in the future. In a case where such a large diameter wafer is polished on both surfaces thereof, a scale will be tremendously larger in a multicarrier type double-side polishing apparatus using plural carriers as in the case of the planetary gear mechanism type, leading to much of difficulty in securing a mechanical precision or suppressing an apparatus cost. In order to meet a high flatness required of a wafer, it is desired to alter processing conditions of each wafer. In consideration of these aspects, it has been generally understood that a single wafer type apparatus, which processes one wafer at a time, is advantageous for double-side polishing of a large diameter wafer.

The greatest feature in terms of a structure of a single wafer type double-side polishing apparatus is in that the apparatus is of the single carrier type using one carrier larger in outer diameter than the rotatable upper and lower surface plates. In the apparatus, one wafer smaller in diameter than the surface plates is held with the one carrier and the carrier is moved between the upper and lower surface plates in rotation to thereby polish both surfaces of the one large diameter wafer. Needless to say that the apparatus of this kind is smaller in size and is advantageous in the aspect of a price, as compared with the multicarrier type double-side polishing apparatus using plural carriers to simultaneously polish both surfaces of each of the plural wafers. One of such single wafer apparatuses is a "single wafer type double-side polishing apparatus" provided in JP-A 2001-315057.

In the "single wafer type double-side polishing apparatus" provided in JP-A 2001-315057, a carrier holds a wafer at a position eccentric from the center of the carrier. The carrier is arranged concentrically with respect to the upper and lower surface plates and is rotated about its center. The carrier rotates concentrically with respect to the surface plates, that is, makes concentric rotation, so that the wafer held eccentrically revolves around the center of the carrier and is polished on both surfaces thereof.

As a kind of a single carrier type using one carrier, which is not a single wafer type apparatus, provided in JP-A 2000-33559 is a batch type polishing apparatus in which plural wafers are held around the center of the carrier and, also, the carrier is arranged between the upper and lower surface plates eccentrically with respect thereto and moves circularly around the center of the surface plates.

Conventional single wafer type double-side polishing apparatuses including the apparatus provided in JP-A 2001-315057, however, have an intrinsic problem that a flatness of a wafer is harder to be secured from a polishing principle, as compared with a multicarrier type double-side polishing apparatus using plural carriers as in the case of the planetary gear type. The reason why is that in a case of a multicarrier type double-side polishing apparatus using plural carriers, the plural carriers are arranged in the outer peripheral portion of the upper and lower surface plates therebetween. When a carrier is disposed in the outer peripheral portion, a difference between peripheral speeds at the outer and inner sides is small. As a result, the wafers held in the carriers are polished at a comparatively uniform peripheral speed at every point on each of the wafers.

In a case of a single wafer type polishing apparatus, a wafer is slightly different in diameter from the surface plates, though the wafer is smaller in diameter than the surface plates. Therefore, one wafer is polished by the surface plates each using an area from a central portion to an outer peripheral portion thereof. In a case of the single wafer type polishing apparatus described in JP-A 2001-315057 in which the carrier arranged so as to be concentric with respect to the surface plates rotates about its center, a motion of the wafer held eccentrically with respect to the carrier is as shown in FIG. 5.

In FIG. 5, there are shown geometrical motion loci of the center of a 300 mm wafer, intermediate points spaced 75 mm (a half of the radius) in an eccentric direction and a direction opposite the eccentric direction from the center of the wafer and points on the outer edge spaced 150 mm (the radius) in the both directions from the center thereof. Note that though in actual polishing, the wafer rotates in the carrier, it is neglected in FIG. 5. An eccentricity of the wafer with respect to the carrier is 30 mm.

As seen from FIG. 5, in the case of the single wafer-type polishing apparatus described in JP-A 2001-315057 in which the carrier rotates about its center, the center of the wafer only rotates about the center of the surface plates at the same radius in the vicinity of the center of the surface plates. On the other hand, a point on the outer edge of the wafer in an eccentric direction only rotates about the center of the surface plates at the same radius along the outermost peripheral portion of the surface plates. The other points only rotate about the center of the surface plates at respective constant radii between those of the center and outer edge of the wafer. Herein, the peripheral speed of the center of the surface plates in rotation is 0. A peripheral speed of a point on the wafer increases as the point is farther from the center of the surface plates and finally reaches the maximum at a point on the outer edge of the wafer. As a result, a polishing rate at a point on the wafer by the surface plates is greatly different between the central portion and the outer peripheral portion of the wafer and no change occurs in each peripheral speed at a corresponding point on the wafer, leading to difficulty securing a flatness.

In actual polishing, the wafer rotates within the carrier and measures such as that a supply of a polishing liquid to the central portion is increased in order to supplement a difference between peripheral speeds, which prevents a flatness from decreasing to such an extent that would be otherwise expected, whereas even with such measures taken, it is hard to absorb the large difference in peripheral speed, resulting in difficulty securing a flatness.

In FIG. 6, there are shown geometrical loci in a case where the polishing apparatus shown in JP-A 2000-33559 is applied to single wafer type polishing. That is, the polishing apparatus shown in JP-A 2000-33559, which is of a single carrier type using one carrier, is of a batch type in which plural wafers are held in the carrier. In a case where it is assumed that one wafer is held in the carrier concentrically or eccentrically with respect to the center thereof, the carrier moves circularly around the center of the surface plates; therefore, the center of the wafer conducts a circular motion with a small radius corresponding to a circular motion of the carrier in the vicinity of the center of the surface plates. A point on the outer edge of the wafer conducts a circular motion with a small radius corresponding to a circular motion of the carrier in the outer peripheral portion of the surface plates. A point intermediate between both points conducts a circular motion with a small radius corresponding to a circular motion of the carrier in the intermediate portion of the surface plates. Note that, in this case, an eccentricity of the wafer with respect to the carrier is 10 mm and a radius of the circular motion of the carrier is 20 mm.

The polishing apparatus shown in JP-A 2000-33559 is basically the same as the single wafer type polishing apparatus described in JP-A 2001-315057 in that a peripheral speed of the surface plate is largely different according to a point on the wafer in a radial direction thereof, which results in a large difference in polishing rate, whereas the polishing apparatus shown in JP-A 2000-33559 is slightly more advantageous than the single wafer type polishing apparatus described in JP-A 2001-315057 in that points on the wafer alter distances from the center of the surface plates in company with the circular motion with a small radius. On the other hand, the polishing apparatus shown in JP-A 2000-33559 is more disadvantageous than the single wafer type polishing apparatus described in JP-A 2001-315057 in that radii of the motions of the points in a radial direction are small and a radius of a motion of a point in the wafer outer peripheral portion is especially small.

SUMMARY OF THE INVENTION

It is an object of the present invention to provide double-side polishing method and apparatus capable of achieving a higher flatness of a work than a conventional practice even with a single carrier type apparatus of a simple construction.

A double-side polishing method of the present invention, in order to achieve the above object, is a method in which a carrier larger in diameter than upper and lower surface plates that rotate is inserted between the surface plates and, when a work held in the carrier and smaller in diameter than the surface plates is polished on both surfaces of the work by rotation of the upper and lower surface plates, the carrier is rotated about its center and is moved circularly around a position spaced from the center of the carrier as a center.

A double-side polishing apparatus of the present invention comprises: upper and lower surface plates that rotate; a carrier larger in diameter than the upper and lower surface plates and inserted between the upper and lower surface plates while holding a work smaller in diameter than the surface plates; first carrier driving means for rotating the carrier inserted between the surface plates one on the other about its center; and second carrier driving means for moving the carrier circularly around a position spaced from the center of the carrier as a center.

In the present invention, the carrier arranged eccentrically with respect to the rotatable upper and lower surface plates therebetween conducts a composite motion combining a first rotating motion rotating about its center with a second rotating motion moving circularly around a position spaced from the center of the carrier as a center. As a result, a flatness of the work can be improved, as compared with a case where only the first rotating motion is conducted and also as compared with a case where only the second rotating motion is conducted. The reason for the improvement is that though the central portion of the wafer moves in the vicinity of the surface plates, the geometrical motion loci of points on the wafer becomes complex and a peripheral speed alters according to a point on the wafer. The outer peripheral portion of the wafer moves circularly with a large radius near and along the outer periphery of the surface plates and, in addition thereto, the geometrical motion loci of points on the peripheral portion of the wafer becomes complex and a peripheral speed alters according to a point on the peripheral portion of the wafer. Thereby, equalization of peripheral speeds at the points thereon is enhanced at a higher level thereof, leading to improvement on a flatness.

In a case where a behavior of the upper surface plate reciprocating in a direction perpendicular to the central axis thereof and a construction in which the work is held in the carrier eccentrically with respect thereto are combined with the composite motion of the carrier, a flatness of the work is further improved. The reason why is that motions at points on the wafer in a radial direction are further complicated and equalization of peripheral speeds at the points is enhanced at a higher level thereof. While a constraint is great in terms of apparatus, the lower surface plate can also be reciprocated in a direction perpendicular to the central axis thereof in place of the upper surface plate. To be brief, the upper and lower surface plates have only to be moved relatively to each other in a direction perpendicular to the central axes.

The carrier driving means causing the carrier to conduct a composite motion preferably has, from the viewpoint of simplification thereof, plural eccentric gears, that mesh with external teeth formed on the outer peripheral surface of the carrier at plural positions along a circumferential direction thereof and, also, revolve around positions spaced from the centers thereof in synchronism with each other or one another at the plural positions of meshing, and plays roles as the first carrier driving means and the second carrier driving means. That is, with the carrier driving means adopted, the carrier conducts a circular motion while being rotated about the center thereof with the help of motions of periodical eccentric rotation of plural eccentric gears.

As for a circular motion of the carrier, it is reasonable from a standpoint of apparatus construction or the like to arrange the carrier eccentrically with respect to the upper and lower surface plates therebetween to thereby move the carrier circularly around the center of the surface plates.

The present invention is especially effective for a single wafer type apparatus for holding a wafer with one carrier. The reason therefor is that in the single wafer type apparatus, the surface plates and a wafer are not greatly different in size from each other and arranged in a state where both are almost concentric with respect to each other, which intrinsically renders a difference in polishing rate excessively large. However, the present invention is also applicable to and is effective for a batch type apparatus for holding plural wafers with one carrier (an apparatus in which plural wafers are held around the center of a carrier).

In double-side polishing method and apparatus of the present invention, a carrier larger in diameter than upper and lower surface plates that rotate is inserted between the surface plates and, when a work held in the carrier is polished on both surfaces thereof by rotation of the upper and lower surface plates, the carrier rotates about its center and is simultaneously moved circularly around a position spaced from the center of the carrier as a center to thereby enable a flatness of a work to be enhanced to a value near a level achieved by the multicarrier type even with a single carrier type of a simple apparatus construction.

DESCRIPTION OF THE PREFERRED EMBODIMENT

Figure 1:
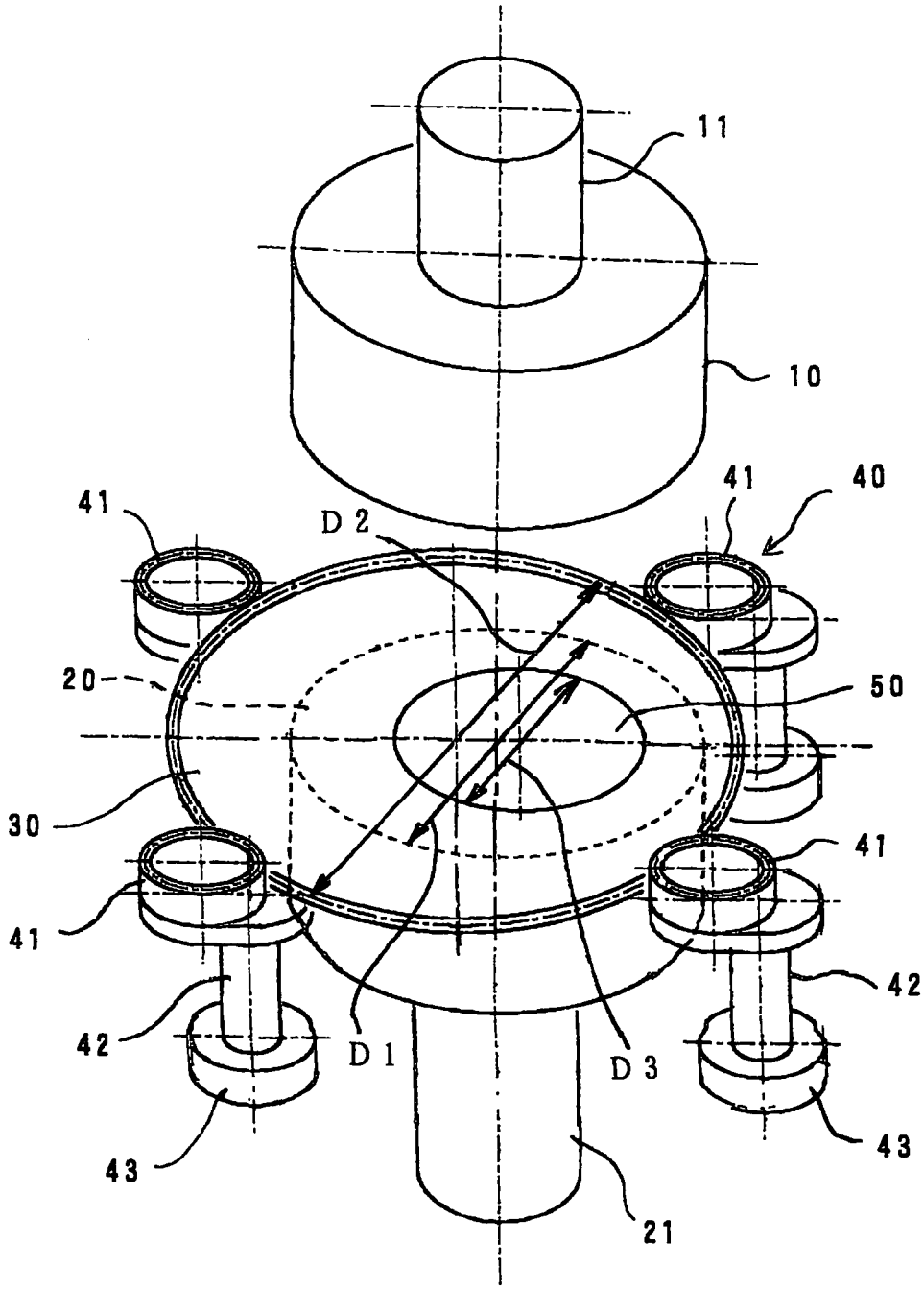
FIG. 1 is a schematic view of construction of a double-side polishing apparatus showing an embodiment of the present invention.

Description will be given of an embodiment of the present invention below based on the accompanying drawings. FIG. 1 is a schematic view of construction of a double-side polishing apparatus showing an embodiment of the present invention, FIG. 2 is a side view of the double-side polishing apparatus, FIG. 3 is a plan view of the double-side polishing apparatus, and FIG. 4 is a plan view showing geometrical loci of motions of points on a wafer in the double-side polishing apparatus.

Figure 2:
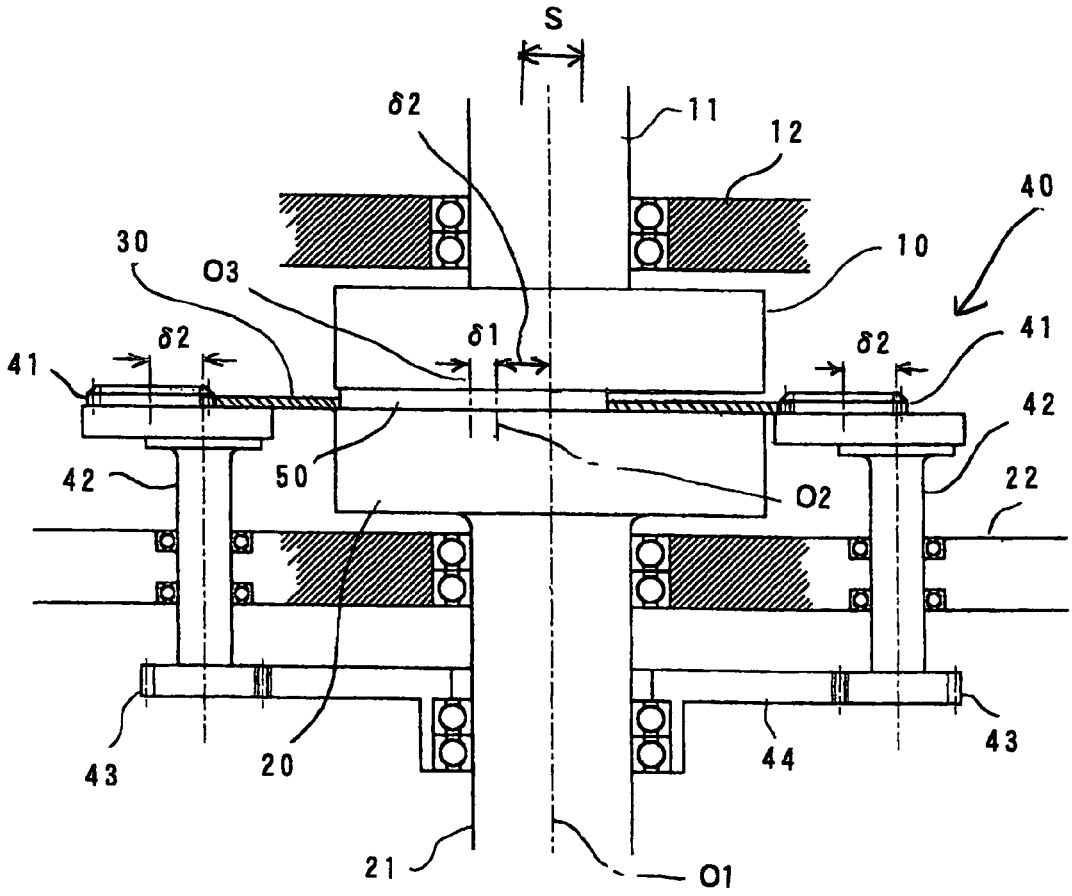
FIG. 2 is a side view of the double-side polishing apparatus.
Figure 3:
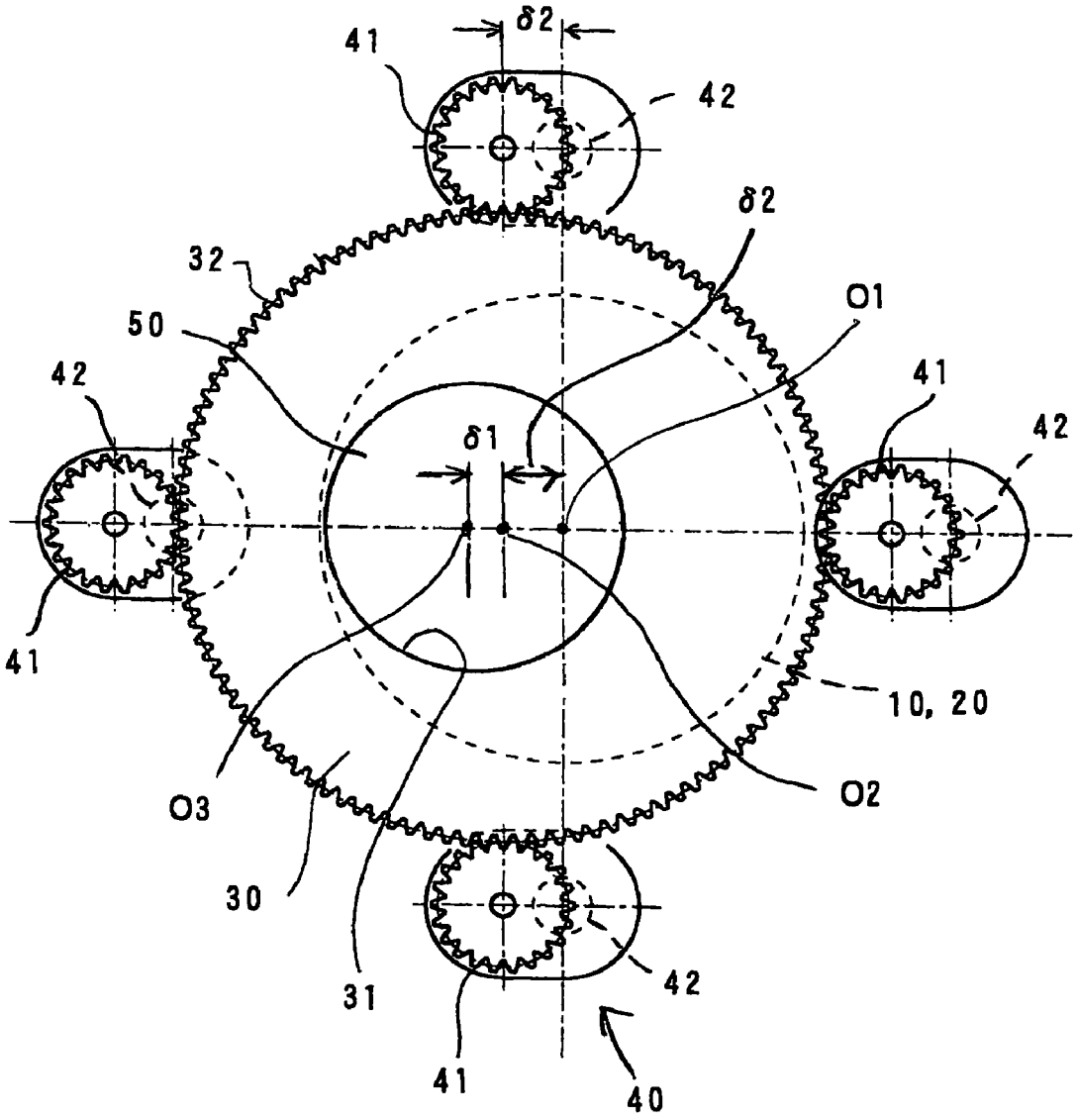
FIG. 3 is a plan view of the double-side polishing apparatus.
Figure 4:
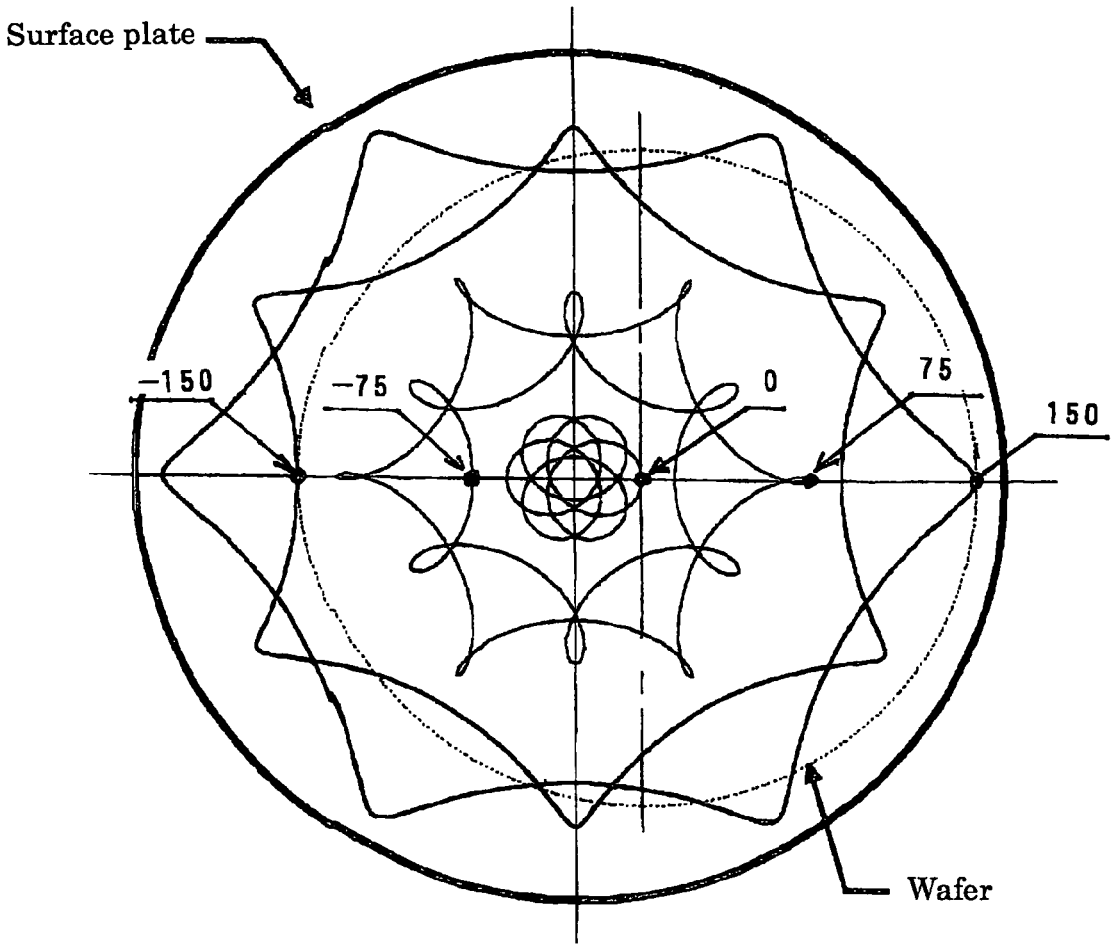
FIG. 4 is a plan view showing geometrical loci of motions of points on a wafer when the double-side polishing apparatus is employed.

A double-side polishing apparatus of this embodiment is, as shown in FIGS. 1 to 3, a single wafer type polishing apparatus used in double-side polishing of a silicon wafer 50 and of a single carrier type. The double-side polishing apparatus comprises upper and lower surface plates 10 and 20, a carrier 30 inserted between the surface plates 10 and 20, and carrier driving means 40 causing the carrier 30 to conduct a composite motion between the surface plates 10 and 20.

The surface plates 10 and 20 are disposed so as to face each other one on above and a polishing pad is attached to each of opposite surfaces of the plates. Diameters D1 of the surface plates 10 and 20 are larger than a diameter D3 of the wafer 50 as a work, while being smaller than a diameter D2 of the carrier 30. Note that diameters of the surface plates in this case are the same as each other, while being not limited to being the same. In a case where diameters of the surface plates 10 and 20 are not the same as each other, a diameter of a surface plate smaller in diameter has only to be larger than the diameter D3 of the wafer 50.

The upper surface plate 10 is mounted horizontally to the lower end of a vertical driving shaft 11. The driving shaft 11 is supported freely rotatably by an upper frame 12 and rotation-driven about the center by driving means (not shown) to thereby rotate the surface plate 10. The driving shaft 11 together with the upper frame 12 is further driven vertically in a vertical direction in order to move the surface plate 10 vertically. Furthermore, in order to reciprocate the surface plate 10 in a direction perpendicular to the rotation center of the surface plate 10, the surface plate 10 is reciprocated in a horizontal direction with a prescribed stroke S.

The lower surface plate 20 is placed concentrically with respect to the upper surface plate 10 therebelow and is mounted to the top end of a vertical driving shaft 21 horizontally. The driving shaft 21 is freely rotatably supported by a lower frame 22 and is rotation-driven about the center thereof by driving means (not shown) to thereby rotate the surface plate 20 at a fixed position.

The carrier 30 is a disk thinner than the wafer 50 and larger in diameter than the surface plates 10 and 20, and has a wafer housing hole 31 for housing the wafer 50 at a position eccentric by a distance δ1 from the center O2 of the disk and external gear teeth 32 on the outer peripheral surface.

The carrier driving means 40 have plural pinion gears 41 . . . (four pinion gears in the figure) meshed with the external gear teeth 32 of the carrier 30. The plural pinion gears 41 . . . are disposed at a prescribed angular spacing in a circumferential direction (at an angular spacing of 90° in the figure) and are mounted on the top surfaces of vertical shaft like driving members 42 . . . so as to be non-rotatably fixed thereto.

The driving members 42 . . . are disposed along a circle concentrically with respect to the surface plate 20 on the outer periphery thereof and intermediate portions thereof are freely rotatably supported by the lower frame 22. Small diameter auxiliary driving gears 43 are mounted to the lower ends of the driving members 42 . . . concentrically with respect thereto. The auxiliary driving gears 43 are meshed with a main driving gear 44 having a large diameter and internally disposed, and the main driving gear 44 is rotation-driven using driving means (not shown) to thereby rotate the driving members 42 . . . in synchronism with each other in the same direction. Note that the main driving gear 44 is freely rotatably mounted on the driving shaft 21 with a bearing interposed therebetween.

The plural pinion gears 41 . . . mounted to the top surfaces of the driving members 42 . . . are disposed so as to be eccentric from the rotation centers of the respective driving members 42 by an equal distance of δ2 in the same direction to thereby construct the eccentric gears in the present invention. Thereby, the carrier 30 meshed with the pinion gears 41 . . . is also supported between the surface plates 10 and 20 with an eccentricity of the same distance δ2 relative to the surface plate center O1 in the same eccentric direction as the pinion gears 41 . . . . A symbol O3 indicates the center of the wafer 50.

Description will be given of a double-side polishing method for the wafer 50 using the double-side polishing apparatus of this embodiment.

The wafer 50 together with the carrier 30 is set onto the lower surface plates 20 in a state where the upper surface plate 10 has been raised. The carrier 30 meshes with the pinion gears 41 . . . outside. Thereby, the wafer 50 and the carrier 30 are set with an eccentricity with respect to the surface plates 10 and 20. After the wafer 50 and the carrier 30 are set, the upper surface plate 10 is moved down to sandwich the wafer 50 between the surface plates 10 and 20. A polishing liquid is supplied between the surface plates 10 and 20 from a polishing liquid supply mechanism (not shown), and the surface plates 10 and 20 are rotated, for example, in the same speed as each other in opposed directions while the polishing liquid is supplied. Simultaneously therewith, the main driving gear 44 is rotated. Thereby, the driving members 42 . . . disposed along the periphery of the surface plate 20 are rotated in synchronism with and in the same direction as each other or one another.

The pinion gears 41 . . . are revolved around the centers of the driving members 42 . . . with an eccentricity by rotation of the driving members 42 . . . in synchronism with each other or one another. That is, the pinion gears 41 . . . conducts one rotation about its center thereof while conducting one revolution around the centers of the driving members 42 . . . . Thereby, the carrier 30 conducts a concentric rotation about the center O2 thereof and, simultaneously, conducts a circular motion with a radius δ2 about the rotation centers O1 of the surface plates 10 and 20. In other words, the carrier 30 together with the pinion gears 41 . . . for a concentric rotation thereof and meshing therewith conducts a circular motion with a radius of δ2 about the rotation centers O1 of the surface plates 10 and 20.

As a result, the wafer 50 held eccentrically in the carrier 30 firstly conducts a circular motion with a radius of δ2 around the rotation centers O1 of the surface plates 10 and 20 by a circular motion of the carrier 30. Secondly, the wafer 50 conducts a circular motion rotating at a radius of δ1 around the rotation center O2 of the carrier 30 and a concentric rotation about the center O3 thereof by a circular motion of the carrier 30. Furthermore, the upper surface plate 20 reciprocates (oscillates) in a direction perpendicular to the central axis thereof with a stroke S.

By combining three kinds of such rotating motions and one kind of such a linear motion with rotation of the surface plates 10 and 20, a flatness of the wafer 50 is drastically improved.

It is important to consider a polishing efficiency and a flatness in determination of diameters D2 of the surface plates 10 and 20, a diameter D3 of the carrier 30, an eccentricity δ2 of the carrier 30 with respect to the surface plates 10 and 20, an eccentricity δ1 of the wafer 50 in the carrier 30, a rotational speed v1 of the carrier 30 about its center, a circular motion speed v2 of the carrier 30 and a reciprocating stroke S of the surface plate 10. In order to secure a flatness, it is also important that the wafer 50 is present between the surface plates 10 and 20 all the time. In addition, a value of δ1+δ2+S is desirably smaller than one half of a radius of the wafer 50. The reason therefor is that, if the center of a load is not on the wafer, a load distribution is unequalized, thereby disabling achievement of a high flatness to be achieved. The above conditions are determined in a way such that a polishing efficiency, a flatness and the like meet a desirably high level.

The geometrical motion loci of a carrier shown in FIG. 4 are those of points on a wafer obtained by combining a concentric rotation of a carrier about its center and a circular motion thereof, wherein the points include the center of a 300 mm wafer, the intermediate points in an eccentric direction and a direction opposite the eccentric direction at distances of 75 mm (one half of the radius) from the center thereof, and points on the outer edge in an eccentric direction and a direction opposite the eccentric direction at a distance of 150 mm (the radius) from the center thereof. An eccentricity δ1 of the wafer in the carrier is set 10 mm and a radius δ2 of the circular motion of the carrier is set 20 mm for comparison with FIG. 6, and a ratio (v2/v1) in speed of a concentric rotation to a circular motion of the carrier is set 5. Note that while in an actual polishing, the wafer rotates in the carrier, the rotation is neglected in FIG. 4. A horizontal motion of the upper surface plate is not adopted in the figure.

Figure 5:
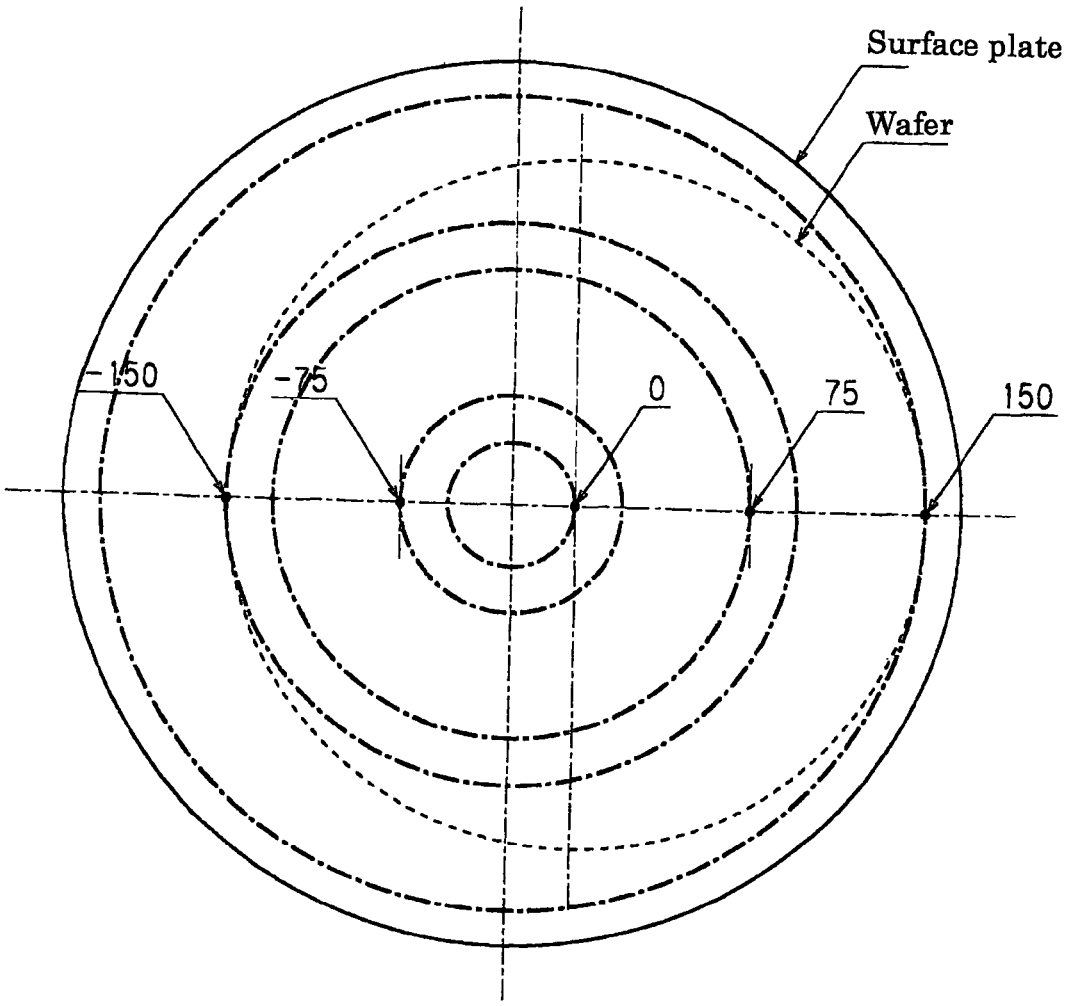
FIG. 5 is a plan view showing geometrical motion loci of motions on a wafer when a conventional double-side polishing apparatus is employed.
Figure 6:
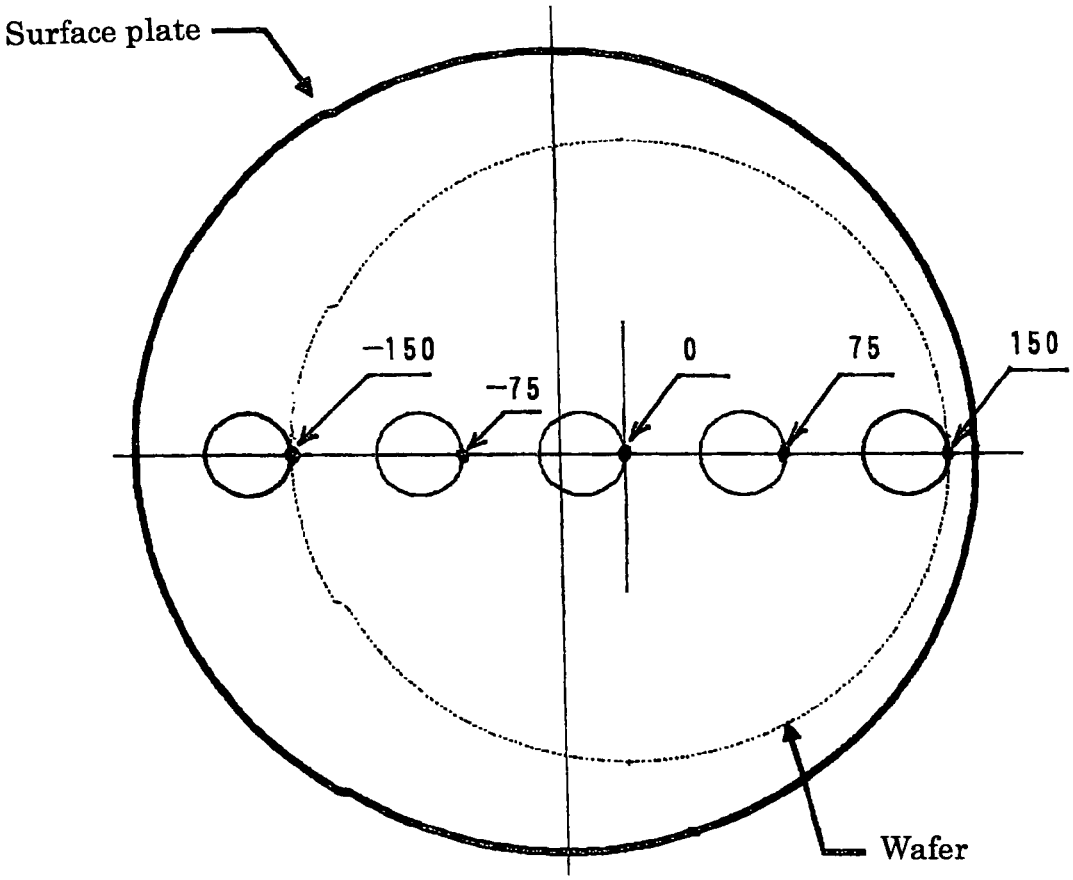
FIG. 6 is a plan view showing geometrical motion loci of motions on a wafer when another conventional double-side polishing apparatus is employed.

In the double-side polishing apparatus of this embodiment, as seen from comparison between FIGS. 5 and 6, geometrical motion loci of points on the wafer in the central portion thereof are extremely complex and peripheral speeds of the points alter to great extents, though the points in the central portion of the wafer conducts circular motions in the vicinity of the center of the surface plates. Geometrical motion loci of points on the wafer in the outer peripheral portion thereof are of rotating motions with large radii near and along the outer periphery with complexity and peripheral speeds of the points alter. With the help of the geometrical motion loci of points on the wafer, equalization of peripheral speeds of points on the wafer is enhanced to a higher level to thereby improve a flatness. In a case where the upper surface plate is reciprocated along a direction perpendicular to the central axis, it is apparent that a flatness of the wafer is further improved.

Rotational directions of the surface plates 10 and 20 may be the same as each other, but in order to offset rotational forces and to alleviate a burden imposed on the carrier 30, opposed directions thereof are adopted. In the case of the opposed directions adopted, a rotational direction of the carrier 30 is the same as one of the opposed directions of the surface plates 10 and 20. In a case where rotational directions of the surface plates 10 and 20 are the same as each other, a rotational direction of the carrier 30 is generally opposite the rotational directions of the surface plates 10 and 20 in order to offset rotational forces, while it is also possible for the carrier 30 to adopt the same rotational direction as those of the surface plates 10 and 20, but at a speed different from those of the surface plates 10 and 20.

EXAMPLE

Then, there is shown an example of the present invention in which a silicon wafer is polished simultaneously on both sides thereof according to the present invention and by comparison with a conventional example, the effect of the present invention will be made clear.

The double-side polishing apparatus (with a diameter of each of the surface plates of 380 mm) shown in FIGS. 1 to 3 was used and a 300 mm silicon wafer of 0.8 mm in thickness was polished on both sides thereof using the following members or materials, which were used in a general primary polishing stage of a silicon wafer.

A carrier to be used: a resin carrier (outer diameter: 510 mm, thickness: 0.7 mm).

A polishing pad: a polishing cloth SUBA800 manufactured by Rodel Nitta Company.

A polishing liquid: a 20-fold diluted slurry of Nalco 2350.

Polishing conditions were as follows. The upper and lower surface plates were rotated in opposed directions at a speed of 20 rpm in order to reduce a burden on the carrier and a polishing pressure was 150 g/cm$^2$. An eccentricity δ1 of the wafer in the carrier was 20 mm and an eccentricity δ2 of the carrier with respect to the surface plates (a radius of a circular motion of the carrier) was 30 mm so that a locus of a point on the outermost periphery of the wafer passes through the outermost periphery of the surface plates. In addition, a speed of concentric rotation of the carrier v1 was 7.5 rpm and a ratio in speed of a concentric rotation to a circular motion of the carrier (v2/v1) was set 5.

Figure 7:
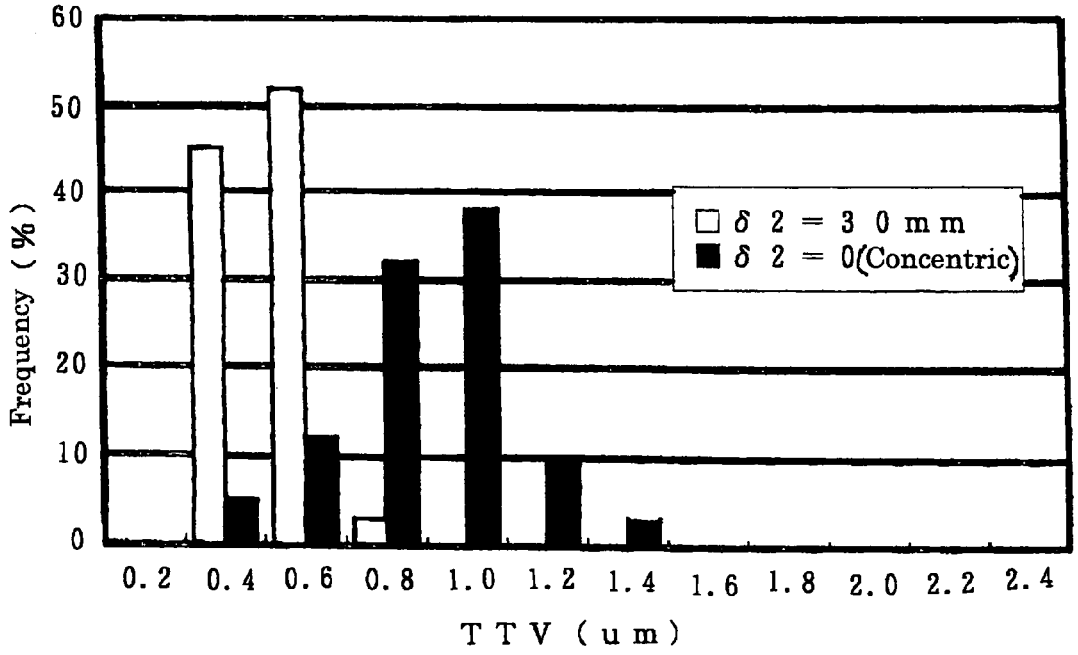
FIG. 7 is a graph showing flatness precision after double-side polishing is over in an example of the present invention and a conventional example.

In FIG. 7, there is shown a total thickness variation (TTV) of the silicon wafer after double-side polishing was over. All values of the TTV obtained were of the order of submicrons and a good flatness precision of the wafer was secured with a small outer peripheral rounding in the primary polishing, which would have been worried to be larger than actual. The polishing cloth, which is a main material, was exchanged to SUBA600 or SUBA400, softer than SUBA800 to conduct similar polishing, smooth polishing was able to be realized though a polishing efficiency was reduced and thereby it was also confirmed that a good flatness precision of the same order was able to be secured.

For a comparative purpose, as a double-side polishing apparatus, there was used the apparatus shown in FIG. 5, that is a single wafer type polishing apparatus (with an eccentricity δ2 of the carrier with respect to the surface plates=0) of JP-A 2001-315057 in which the carrier arranged concentrically with respect to the upper and lower surface plates rotates about its center while holding the wafer with an eccentricity. Polishing conditions were, so as to enable comparison with the example, as follows: an eccentricity of a silicon wafer in the carrier was set 20 mm and a speed of concentric rotation of the carrier was set 7.5 rpm. Specifications of the surface plates, operating conditions and members and materials to be used were the same as in this example. In FIG. 7, there is shown the total thickness variation (TTV) of the silicon wafer after double-side polishing was over together.

Superiority of the present invention is apparent from FIG. 7.

Note that while, in the above-described embodiment, the main driving gear 44 in the interior of the system, meshed with the auxiliary driving gears 43 of the driving members 42 . . . is employed to drive the plural pinion gears 41 . . . and the driving members 42 . . . , a construction may be adopted in which a belt gear for driving is externally wound around the auxiliary driving gears 43 from the outside instead of the above mechanism and, in a case where the wafer 50 is of a larger diameter, it can be said to be rather preferable to employ a belt gear because of adoption of a larger diameter of the main driving gear 44 along with increase in size of the surface plates 10 and 20, and the carrier 30.

While in the above-described embodiment, the number of the pinion gears 41 . . . , each of which is an eccentric gear, is four, three pinion gears 41 . . . may be adopted, it is essential to be two or more in the number thereof and specific limitation is imposed on the number thereof. As for arrangement of the eccentric gears, while in the above-described embodiment, the gears are arranged at an equal angular spacing in the circumferential direction, the arrangement at an equal spacing is not necessarily required.

What is claimed is:

1. A double-side polishing method, comprising the steps of:

providing a carrier larger in diameter than a diameter of upper and lower surface plates;

holding a work smaller in diameter than the diameter of the surface plates in the carrier;

inserting the carrier and the work held therein between the surface plates in order to polish both surfaces of the work;

rotating the upper and lower surface plates;

rotating the carrier about its center; and moving the carrier circularly around a position spaced from the center of the carrier as a center.

2. The double-side polishing method according to claim 1, further comprising moving the carrier circularly by plural gears externally meshed therewith in order to rotate the carrier about its center.

3. The double-side polishing method according to claim 1, wherein the carrier holds one wafer concentrically or eccentrically with respect thereto.

4. The double-side polishing method according to claim 1, further comprising placing the carrier between the upper and lower surface plates eccentrically with respect thereto.

5. The double-side polishing method according to claim 1, further comprising reciprocating the upper surface plate relatively to the lower surface plate in a direction perpendicular to the central axis.

6. A double-side polishing apparatus comprising:

upper and lower surface plates that rotate;

a carrier larger in diameter than the upper and lower surface plates and inserted between the upper and lower surface plates while holding a work smaller in diameter than the surface plates;

first carrier driving means for rotating the carrier inserted between the upper and lower surface plates about its center; and second carrier driving means for moving the carrier circularly around a position spaced from the center of the carrier as a center.

7. The double-side polishing apparatus according to claim 6, wherein the carrier holds one wafer concentrically or eccentrically with respect thereto.

8. The double-side polishing apparatus according to claim 6, wherein the carrier is placed between the upper and lower surface plates eccentrically with respect thereto, and the second carrier driving means moves the carrier circularly around the center of the surface plates.

9. The double-side polishing apparatus according to claim 6, wherein the carrier driving means has plural eccentric gears, that mesh with external teeth formed on the outer peripheral surface of the carrier at plural positions along a circumferential direction thereof and, also, revolve around positions spaced from the centers thereof in synchronism with each other or one another at the plural positions of meshing, and plays roles as the first carrier driving means and the second carrier driving means.

10. The double-side polishing apparatus according to claim 6, comprising surface plate driving means for reciprocating the upper surface plate relatively to the lower surface plate in a direction perpendicular to the central axis.

* * * * *